US006651359B1

(12) United States Patent
Bricker

(10) Patent No.: US 6,651,359 B1
(45) Date of Patent: Nov. 25, 2003

(54) INTERCHANGEABLE SHOE STRAP SYSTEM

(76) Inventor: Cheryl D. Bricker, 1950 Tamarind Ave. #227, Los Angeles, CA (US) 90068

( * ) Notice: Subject to any disclaimer, the term of this patent is extended or adjusted under 35 U.S.C. 154(b) by 89 days.

(21) Appl. No.: 09/948,736

(22) Filed: Sep. 7, 2001

(51) Int. Cl.[7] ..... A43B 3/24
(52) U.S. Cl. ..... 36/101; 36/11.5
(58) Field of Search ..... 36/101, 100, 11.5, 36/7.5; D2/973, 919, 896

(56) References Cited

U.S. PATENT DOCUMENTS 2,887,792 A * 5/1959 Staff ..... 36/100
2,887,795 A * 5/1959 Taicher ..... 36/58.5
3,032,896 A * 5/1962 Weaver ..... 36/101
3,221,421 A * 12/1965 Liebmann et al. ..... 36/100
3,494,053 A * 2/1970 Kennedy ..... 36/100
3,999,311 A 12/1976 Epstein
4,439,935 A 4/1984 Kelly
4,450,633 A 5/1984 Connelly
4,461,102 A 7/1984 DeVincentis
D346,686 S 5/1994 Hatfield
5,946,823 A * 9/1999 Yates ..... 36/11.5
5,992,058 A 11/1999 Jneid
6,212,797 B1 * 4/2001 Merry et al. ..... 36/101
6,430,845 B1 * 8/2002 Noda ..... 36/100

* cited by examiner

*Primary Examiner*—Jila M. Mohandesi

(57) ABSTRACT

An interchangeable shoe strap system for altering the decorative look of a shoe. The interchangeable shoe strap system includes a shoe having strap members for securing the shoe to a user's foot, and a plurality of decorative strap covers which are selectively couplable to the strap members for altering the overall appearance of the shoe.

2 Claims, 2 Drawing Sheets

INTERCHANGEABLE SHOE STRAP SYSTEM

BACKGROUND OF THE INVENTION

1. Field of the Invention

The present invention relates to interchangeable shoe straps and more particularly pertains to a new interchangeable shoe strap system for altering the decorative look of a shoe.

2. Description of the Prior Art

The use of interchangeable shoe straps is known in the prior art. More specifically, interchangeable shoe straps heretofore devised and utilized are known to consist basically of familiar, expected and obvious structural configurations, notwithstanding the myriad of designs encompassed by the crowded prior art which have been developed for the fulfillment of countless objectives and requirements.

Known-prior art includes U.S. Pat. Nos. 5,992,058; 3,999,311; 4,439,935; 4,461,102; 4,450,633; and U.S. Patent No. Des. 346,686.

While these devices fulfill their respective, particular objectives and requirements, the aforementioned patents do not disclose a new interchangeable shoe strap system. The inventive device includes a shoe having strap members for securing the shoe to a user's foot, and a plurality of decorative strap covers which are selectively couplable to the strap members for altering the overall appearance of the shoe.

In these respects, the interchangeable shoe strap system according to the present invention substantially departs from the conventional concepts and designs of the prior art, and in so doing provides an apparatus primarily developed for the purpose of altering the decorative look of a shoe.

SUMMARY OF THE INVENTION

In view of the foregoing disadvantages inherent in the known types of interchangeable shoe straps now present in the prior art, the present invention provides a new interchangeable shoe strap system construction wherein the same can be utilized for altering the decorative look of a shoe.

The general purpose of the present invention, which will be described subsequently in greater detail, is to provide a new interchangeable shoe strap system apparatus and method which has many of the advantages of the interchangeable shoe straps mentioned heretofore and many novel features that result in a new interchangeable shoe strap system which is not anticipated, rendered obvious, suggested, or even implied by any of the prior art interchangeable shoe straps, either alone or in any combination thereof.

To attain this, the present invention generally comprises a shoe having strap members for securing the shoe to a user's foot, and a plurality of decorative strap covers which are selectively couplable to the strap members for altering the overall appearance of the shoe.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new interchangeable shoe strap system apparatus and method which has many of the advantages of the interchangeable shoe straps mentioned heretofore and many novel features that result in a new interchangeable shoe strap system which is not anticipated, rendered obvious, suggested, or even implied by any of the prior art interchangeable shoe straps, either alone or in any combination thereof.

It is another object of the present invention to provide a new interchangeable shoe strap system which may be easily and efficiently manufactured and marketed.

It is a further object of the present invention to provide a new interchangeable shoe strap system which is of a durable and reliable construction.

An even further object of the present invention is to provide a new interchangeable shoe strap system which is susceptible of a low cost of manufacture with regard to both materials and labor, and which accordingly is then susceptible of low prices of sale to the consuming public, thereby making such interchangeable shoe strap system economically available to the buying public.

Still yet another object of the present invention is to provide a new interchangeable shoe strap system which provides in the apparatuses and methods of the prior art some of the advantages thereof, while simultaneously overcoming some of the disadvantages normally associated therewith.

Still another object of the present invention is to provide a new interchangeable shoe strap system for altering the decorative look of a shoe.

Yet another object of the present invention is to provide a new interchangeable shoe strap system which includes a shoe having strap members for securing the shoe to a user's foot, and a plurality of decorative strap covers which are selectively couplable to the strap members for altering the overall appearance of the shoe.

Still yet another object of the present invention is to provide a new interchangeable shoe strap system that allows the user to quickly and easily alter the appearance of a single pair of shoes to match a variety of outfits worn by the user.

Even still another object of the present invention is to provide a new interchangeable shoe strap system that reduces the need for many pairs of shoes just to be able to match the variety of attire worn, which also limits the number of pairs of shoes required to be taken with when traveling, thereby saving packing space.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
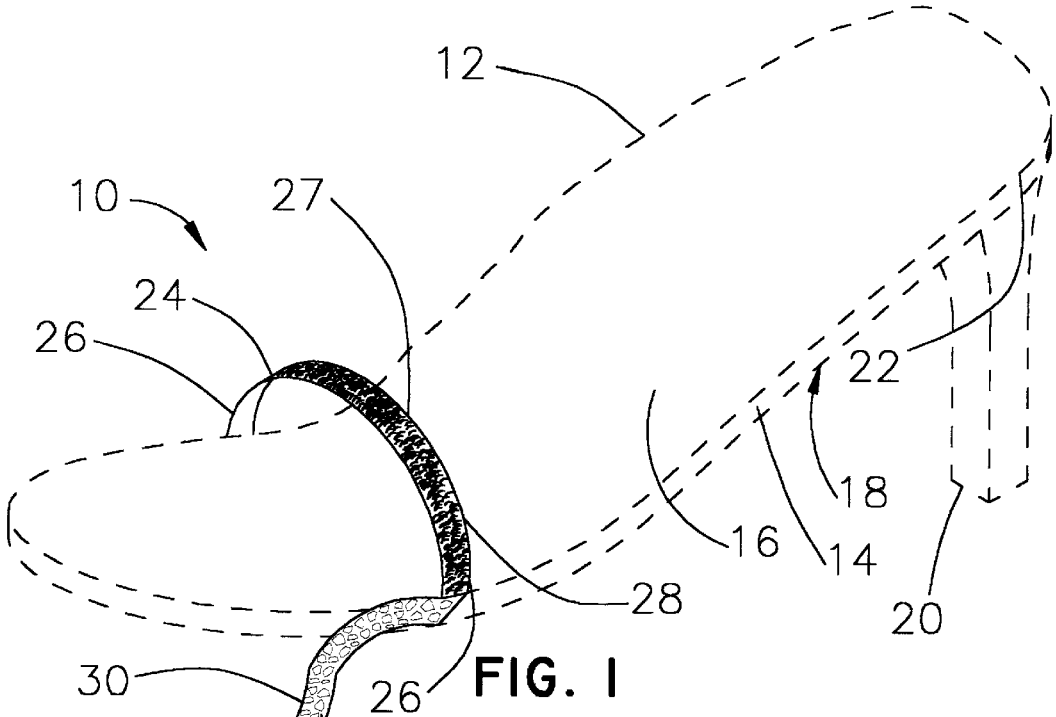
FIG. 1 is a schematic perspective view of a new interchangeable shoe strap system according to the present invention.
Figure 2:
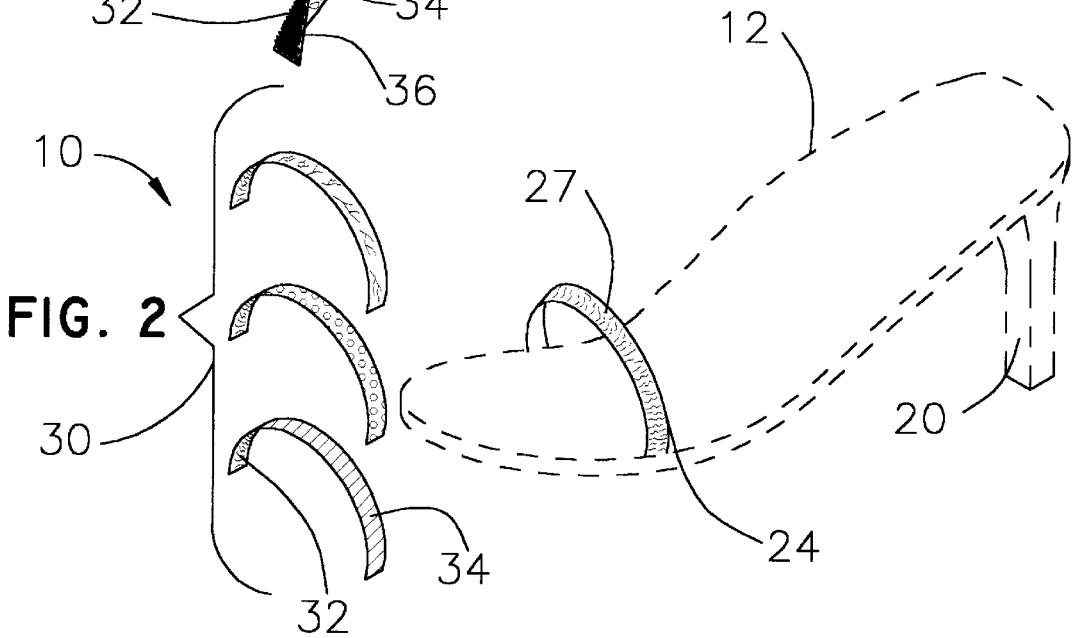
FIG. 2 is a schematic perspective view of the present invention depicting a sample of the decorative strap covers.
Figure 3:
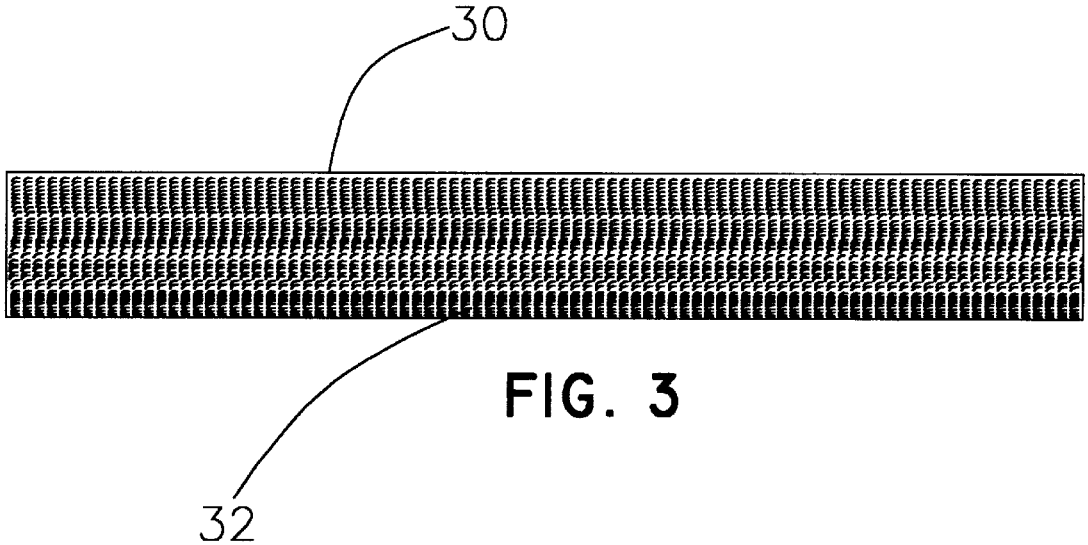
FIG. 3 is a view of the coupling side of the decorative strap cover of the present invention.

With reference now to the drawings, and in particular to FIGS. 1 through 3 thereof, a new interchangeable shoe strap system embodying the principles and concepts of the present invention and generally designated by the reference numeral 10 will be described.

As best illustrated in FIGS. 1 through 3, the interchangeable shoe strap system 10 generally comprises a shoe 12 with a sole member 14. The sole member 14 has an upper surface 16 and a lower surface 18. A heel member 20 is coupled to a rear portion 22 of the lower surface 18 for providing support and a height variance of the user.

The upper surface 16 of the sole member 14 is designed for contouring to a foot of a user such that a bottom of a user's foot contacts the upper surface 16 of the sole member 14.

At least one strap member 24 is fixedly coupled to side edges 26 of the sole member 14. The strap member 24 is elongated such that a length of said strap member 24 is at least ten times a width of said strap member 24. The strap member 24 is designed for securing the foot of a user to the shoe 12.

The strap member 24 has a first portion of a hook and loop fastener 28. The first portion of a hook and loop fastener 28 is an integral part of a top side 27 of the strap member 24 such that the top side 27 of the strap member 24 is designed for receiving a plurality of decorative strap covers 30 for altering an overall decorative look of the shoe 12.

The heel member 20 is of a variety of styles and heights for any one particular shoe 12 design or size, all of which shoe designs include at least one strap member 24 for allowing the use of the decorative strap covers 30.

The decorative strap covers 30 comprise a coupling side 32 and a decorative side 34. The coupling side 32 includes a second portion of a hook and loop fastener 36. The coupling side 32 of the decorative strap cover 30 is designed for selectively coupling to the top side 27 of the strap member 24 such that the decorative side 34 of the decorative strap cover 30 is visible, thereby altering the appearance of the shoe 12 as desired by the user.

In an embodiment, the first portion of hook and loop fastener covers an entire surface of the top side of the strap member and the second portion of hook and loop fastener covers an entire surface of the coupling side of the strap cover to prevent loose edges from snagging while the shoe is being worn.

As alluded to in the previous description of the preferred embodiment, the interchangeable decorative strap system is not limited to any one particular size, shape, or design of shoe. A woman's high-heeled shoe was utilized only as a most likely example. This interchangeable strap system could be utilized on any number of types of footwear. Also, the decorative strap covers are limitless in ornamental design, thus only several examples have been depicted for clarity.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An interchangeable shoe strap system for altering the decorative look of a shoe, the interchangeable shoe strap system comprising:

a shoe having a sole member, said sole member having an upper surface and a lower surface;

said upper surface of said sole member being adapted for contouring to a foot of a user such that a bottom of a user's foot contacts said upper surface of said sole member;

a rectangular strap member having a pair of opposite ends, said strap member being elongated such that a length of said strap member is at least ten times a width of said strap member, said opposite ends of said strap member being coupled to respective sides of said sole member such that a medial portion extending between said opposite ends forms an upper coupled to said sole member, said length of said strap member being such that a foot of the user is held in place against said upper surface of said sole member by said strap member;

said strap member having a first portion of a hook and loop fastener, said first portion of a hook and loop fastener being an integral part of an entire area of a top side of said strap member such that said top side of said strap member being adapted for receiving a plurality of decorative strap covers for altering an overall decorative look of said shoe;

said decorative strap covers comprising a coupling side and a decorative side, said coupling side including a second portion of a hook and loop fastener covering an entirety of said coupling side, said coupling side of said decorative strap covers being adapted for selectively coupling to said top side of said strap member such that said decorative side of said decorative strap covers is visible thereby altering the appearance of said shoe as desired by the user and a medial portion of said decorative strap covers securely fastened to said strap member.

2. The interchangeable shoe strap system of claim 1, further comprising:

a heel member coupled to a rear portion of said lower surface of said sole member for providing support and a height variance of the user.

* * * * *